United States Patent [19]

Filan et al.

[11] 4,171,095

[45] Oct. 16, 1979

[54] SPRINKLER AND VALVE OPERATOR

[76] Inventors: Alton N. Filan; A. LaVerne Filan, both of Rte. 1, Box 69, Waitsburg, Wash. 99361

[21] Appl. No.: 904,793

[22] Filed: May 11, 1978

[51] Int. Cl.[2] ..... B05B 15/06

[52] U.S. Cl. ..... 239/200; 251/148; 137/368; 285/360

[58] Field of Search ..... 239/200, 207; 285/360; 137/320–322, 368; 251/291, 148

[56] References Cited

U.S. PATENT DOCUMENTS

| | | | |
|---|---|---|---|
| 2,033,880 | 3/1936 | Coles et al. | 137/322 |
| 2,881,788 | 4/1959 | Johnson | 137/321 |
| 3,443,581 | 5/1969 | Lyell | 137/322 |

FOREIGN PATENT DOCUMENTS

| | | | |
|---|---|---|---|
| 84533 | 9/1954 | Norway | 239/200 |

*Primary Examiner*—Robert W. Saifer

*Attorney, Agent, or Firm*—Wells, St. John & Roberts

[57] ABSTRACT

A sprinkler and valve operator is disclosed that enables a single rotatable sprinkler head to be mounted coaxially to an upright irrigation pipe valve. The operator is comprised of two independently coaxially rotatable pipe sections that include a central valve operating mechanism. The lower pipe section includes mechanisms for releasably attaching the operator to a standard upright irrigation pipe valve. The valve operating mechanism engages and rotates the irrigation pipe valve actuator in response to rotational movement of the upper pipe section. A removable tripod may be provided to brace the pipe sections against operating forces produced through rotatable sprinkling head attached to the upper pipe section.

11 Claims, 5 Drawing Figures

SPRINKLER AND VALVE OPERATOR

BACKGROUND OF THE INVENTION

It is becoming increasingly popular to utilize single large pattern sprinklers with present agricultural irrigation systems. Such sprinklers may easily be moved by hand from one irrigation standpipe to another. This eliminates the need to otherwise move large, cumbersome sections of irrigation pipe by hand from one location to another. However, present developments in the field for such single sprinkler systems require that the sprinkler be mounted to an above ground pipe and that the sprinkler standpipe be mounted through a right angle joint to the irrigation pipe valve. The difficulty with such mounting is obvious friction loss through the various angular changes that the water must make in its flowpath from the irrigation pipe to the sprinkler nozzle, the complexity, and awkwardness in handling the bulky arrangement. It therefore becomes desirable to obtain some form of irrigation pipe valve operator and sprinkler mount that is coaxially mountable to an irrigation sprinkler valve. It is also desirable to obtain some form of irrigation pipe valve operator that may be utilized with either surface irrigation pipelines or pipelines buried beneath the ground surface.

DETAILED DESCRIPTION

Figure 1:
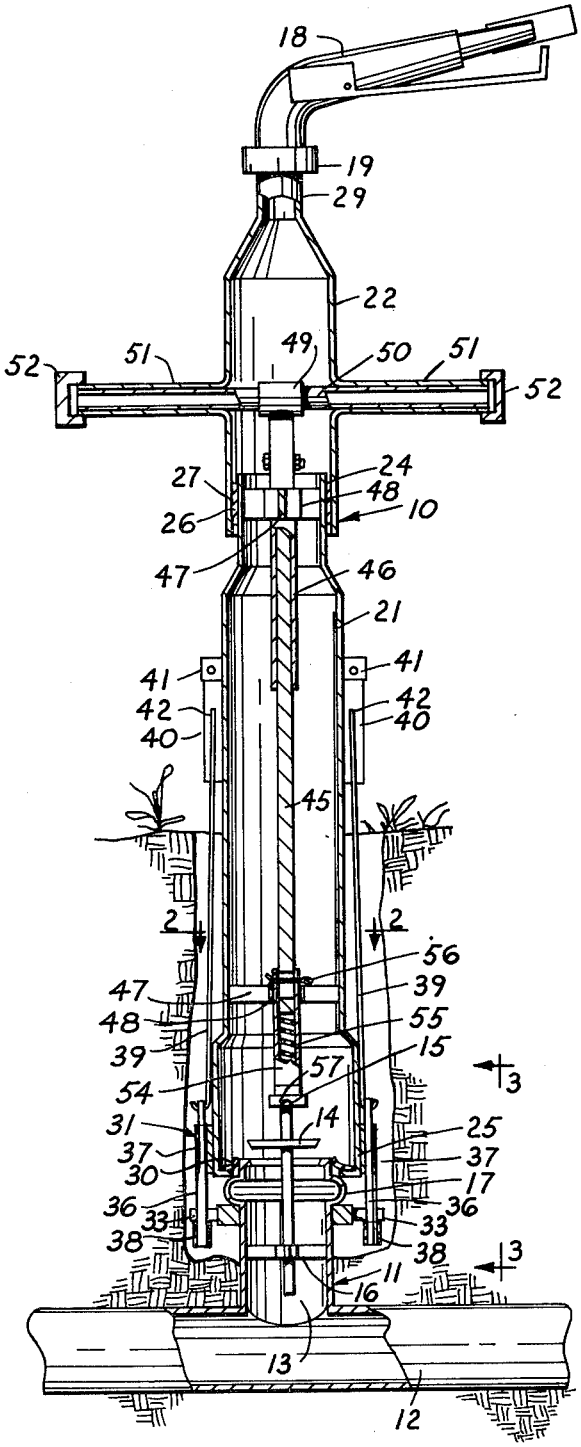
FIG. 1 is a vertical sectioned view of a first form of my sprinkler and valve operator.
Figure 5:
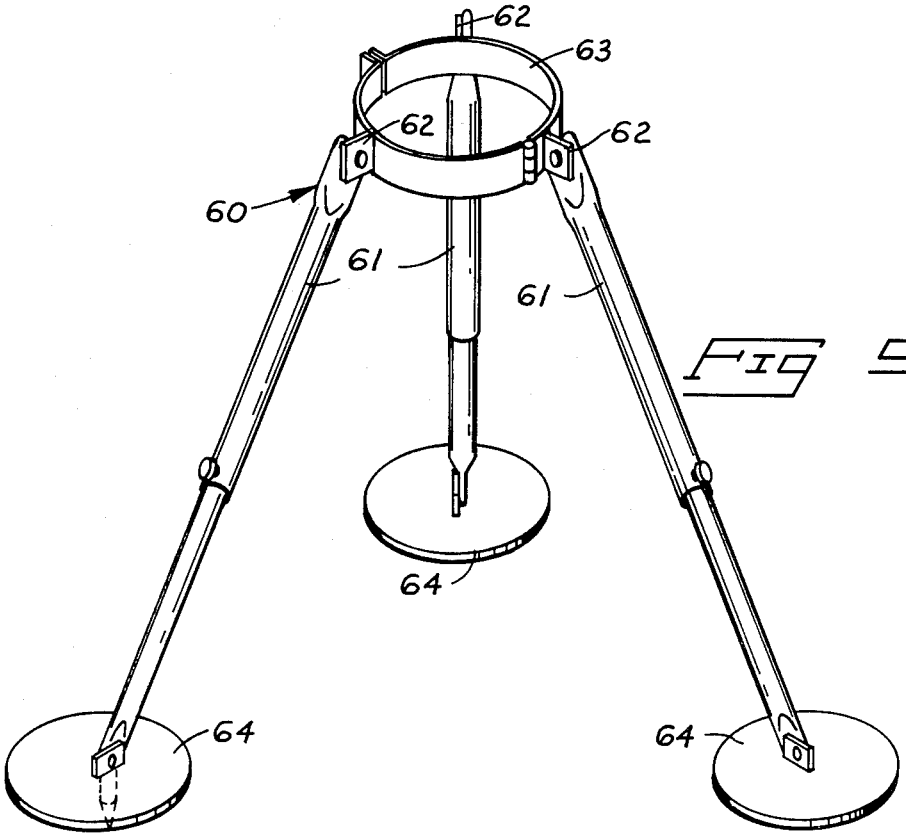
FIG. 5 is a pictorial view of a hinged tripod utilized for supporting the present sprinkler and valve operator.

The operator 10 illustrated in FIG. 1 is intended for use with an upright valve 11 that is buried below the ground surface. The form illustrated in FIG. 5 is intended for use with an above ground pipe and valve arrangement. The two forms illustrated in FIGS. 1 and 5 are substantially identical with the exception of the provisions for attaching the operator to the irrigation pipe valve 11. These distinctions will be discussed in greater detail below.

Both forms of the operator 10 mount to the standard irrigation pipe valve 11 which typically includes an upright substantially cylindrical standpipe 13 that is mounted to or is integral with the irrigation pipe 12. Such valves 11 typically include a valve plate 14 that is mounted to a threaded exterior actuator 15. The actuator 15 threadably engages a central spider 16. Rotation of the actuator will thereby move the plate axially to open or close the valve. An annular rim 17 is generally formed about the upright standpipe 13 adjacent its upper end to facilitate attachment and sealing for different conventional forms of valve openers.

A sprinkler head 18 may be provided along with the present valve operator 10 or may be acquired independently of the operator 10. The sprinkler head 18 shown in the drawings is of conventional construction, being mounted to the operator 10 by a bearing 19. The bearing 19 is coaxial with the valve operator and allows free rotational movement of the sprinkler head 18 about a central vertical axis common to valve 11 and the present operator 10. Other standard provisions, such as an auxiliary shut-off valve (not shown) may also be provided as an attachment to the basic sprinkler and valve operator unit.

The basic sprinkler and valve operator 10 includes a first pipe section 21 and a coaxial second pipe section 22. The two pipe sections 21 and 22 are mounted together for rotation relative to one another about a common central vertical axis.

More specifically, the first pipe section 21 includes an upper end 24 and a lower end 25. A bearing 26 is mounted at the upper end 24 to receive a lower end 27 of the second pipe section 22. The second pipe section 22 includes an upper end 29 that mounts the bearing 19 and sprinkler head 18. Thus it may be seen that the sprinkler head may rotate freely about the vertical central axis independently of the two pipe sections. Further, the pipe sections themselves may rotate relative to one another and to the sprinkler head 18.

The lower end 25 of the first pipe section 21 includes a rubber gasket seal 30. It is utilized to prevent water seepage between the lower pipe end 25 and the valve rim 17. Water pressure forces the flexible rubber seal 30 against the smooth surface of rim 17 and, as pressure increases, the seal will correspondingly become more secure. However, additional mechanism must be provided to hold the entire operator assembly in place on the irrigation pipe valve 11 during operation. Therefore, a mounting means may be provided in two forms of latch mechanisms generally illustrated at 31 in FIGS. 1 and 4.

Figure 3:
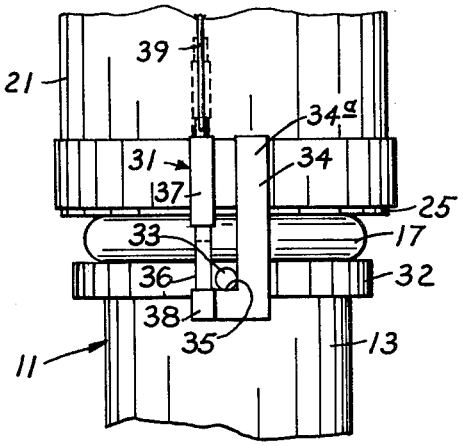
FIG. 3 is a detailed view of a latching mechanism.
Figure 4:
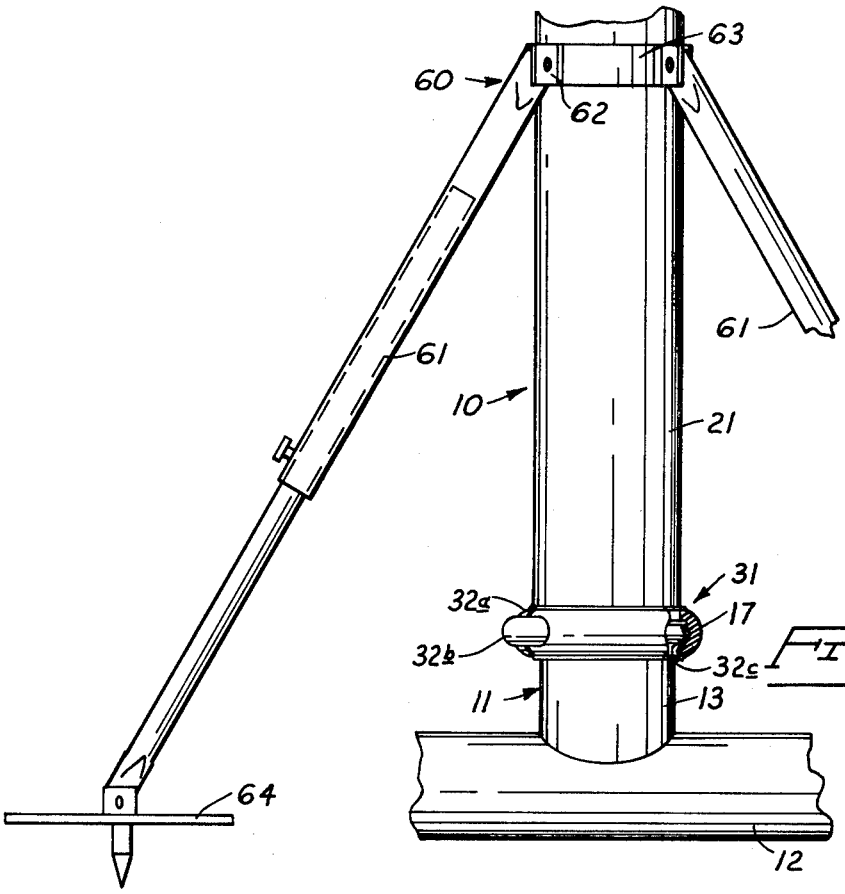
FIG. 4 is a detail of another form of the present invention utilized with surface type irrigation pipe.

A conventional clamping collar **32*a* is provided for the form of operator illustrated in FIG. 4 for directly attaching the operator to the irrigation pipe valve. Collar 32*a* is comprised of a radially expansible split ring having two hinged sections that can be selectively contracted about the rim 17 and pipe end 25 by a latch 32*b*. Inwardly facing surfaces 32*c* of the ring are complementary to adjoining outwardly projecting surfaces of the pipe end 25 and rim 17 to thereby hold the two against relative axial movement. The collar 32*a* may be easily attached to valves on above ground pipelines where the operator has unlimited freedom of movement in which to place and secure the collar. However, in below ground pipe installations the areas about the valves are so confined (FIG. 1) as to prohibit the use of collar 32*a* for mounting purposes. Thus, I have provided the form of latching mechanism illustrated in FIGS. 1–3**.

Figure 2:
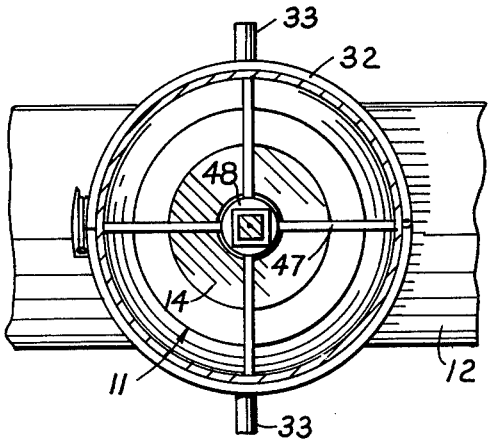
FIG. 2 is an enlarged sectional view taken along line 2—2 in FIG. 1.

The latch mechanism in FIGS. 1–3 includes a releasable collar 32 mounted to upright pipe 13. It includes outwardly projecting dogs 33 that are selectively engaged by a remainder of the latch mechanism that is mounted to the first pipe section 21. The portions of latch mechanism 31 mounted to the first pipe section 21 include at least one and preferably two L-shaped latch members 34 each for receiving a dog 33. The members 34 include upright legs **34*a* (FIG. 3) that are welded or otherwise permanently affixed to the first pipe section 21 at its lower end 25. The horizontal legs of the L-shaped latch members include upwardly facing horizontal surfaces 35. These surfaces are intended to receive the outwardly projecting dogs 33**.

A bolt member 36 is provided for each L-shaped latch member 34. The bolt members 36 are oriented longitudinally at the lower end of first pipe section 21. They are slideably mounted within guide brackets 37.

Sockets 38 are provided at the outer ends of the members 34. The brackets 37 move between open positions clear of the horizontal surfaces 35 (dashed lines in FIG. 3) and closed positions wherein lower ends of the bolt members are received within sockets 38 (solid lines, FIG. 3). The open position enables reception of the dogs 33 along the horizontal surfaces 35. The bolt members 36 close to lock the dogs 33 in position along the horizontal surfaces 35 and between the upright legs 34*a* and bolts 36 when the bolts are received within the sockets 38.

The bolt members 36 are manually moveable between the operative and inoperative positions. Such movement is enabled by connector rods 39 that extend upwardly along the first pipe section 21 to lever arms 40 pivoted thereon. Brackets 41 pivotably mount the lever arms 40 and provide outward connections 42 for the upward ends of the connector rods 39. The lever arms 40 may be pivoted upwardly from a normally vertical position to correspondingly elevate the rods and lift the bolt members 36 upwardly from engagement with the sockets 38. Similarly, downward movement of the levers 40 causes downward movement of the rods 39 and bolt members 36.

As briefly discussed above, the form of latch mechanism illustrated in FIG. 1 is utilized in situations wherein the irrigation pipe valve 11 is buried beneath the ground surface. The levers 40 situated upwardly on the first pipe section 21 facilitate secure mounting of the operator 10 to the irrigation pipe valve 11 without requiring unrestricted access to the buried valve. The entire latching and locking procedure may be accomplished from the above ground location of the levers 40.

A valve operating means is provided that interconnects the two pipe sections 21 and 22 and functions to enable manual opening and closing of the irrigation pipe valve 11 while the operator 10 is mounted coaxially on valve 11. The operating means includes a stem that extends coaxially with the axis of the pipe sections 21 and 22. A first stem member 45 is releasably mounted to a coaxial second stem member 46 for rotation in unison with one another. The stem members 45 and 46 are releasably engaged to facilitate assembly and disassembly of the operator 10 for maintenance and repair purposes. The two members 45 and 46 are rotatably journalled centrally within the pipe sections by two vertically spaced spiders 47. They may include appropriate bearings 48 (FIG. 2) to facilitate free coaxial rotational movement of the stem members relative to the first pipe section 21 about the central axis of a valve 11.

An upper end of the second stem member includes a T-shaped bracket 49 that mounts a transverse handle 50. This handle 50 functions as means for enabling rotation of the valve operating means in response to rotation of the second pipe section 22. Handle 50 is freely received within outwardly projecting tubular housings 51 formed integrally with the second pipe section 22. End caps 52 are provided at outward ends of the housings 51 to prevent escape of water and to allow access to the handle member 50. The handle is either threadably or loosely received within the bracket 49 and may be disengaged from it by removing the caps 52 and sliding handle 50 endwise. The handle 50 is also utilized to provide a downward reaction force between the second pipe section and first to overcome upward thrust forces that would normally be produced against bearing 26.

A lower end of the first stem member slidably mounts an actuator engaging member 54. It is yieldably urged toward a downward actuator engaging position by means of a compression spring 55. A cotter pin 56 is fitted through an aperture at an upper end of the actuator engaging member that slides within an appropriate longitudinal slot in the adjacent stem member. The cotter pin enables relatively free longitudinal movement of the actuator engaging member, but prevents member 54 from dropping away from the stem member when the operator is not in use. A concave indentation 57 is provided at the bottom end of the actuator engaging member 54. Indentation 57 is complementary to the configuration of the upper cross bar of the actuator 15 (which is typically a cylindrical "T" shaped handle).

The operator 10 is initially lowered onto the upright irrigation pipe valve 11 with the actuator engaging member 54 moving downwardly into contact with the actuator 15. The spring 55 will allow the actuator engaging member 54 to move vertically relative to the remainder of the downwardly moving valve operator as the seal is lowered to engage rim 17. The spring 55 provides a continuous downward biasing force against the actuator engaging member while operator 10 is mounted to the irrigation pipe valve 11. The spring initially urges the engaging member 54 against the actuator to snap the indentation into place over the actuator as it is rotated into alignment therewith. Thereafter, rotation of the engaging member 54 will cause corresponding rotation of the actuator 15 to thereby open or close the valve plate 14. Of course, this rotation is caused by manual turning of the second pipe section through provision of the handle 50 and housing 51. The first pipe section remains stationary on the irrigation pipe valve.

An additional feature of the present invention is provision of a removable tripod 60 that is illustrated in FIG. 4. The tripod 60 may include three legs 61 that telescope to adapt for uneven terrain. Each leg 61 is pivotably mounted by brackets 62 to a hinged collar 63. The collar 63 may be removably mounted at a selected elevation on the first pipe section 21 with the legs 61 extending diagonally outward and downward to ground engaging pads 64. The tripod 60 may or may not be utilized with the underground irrigation pipe system illustrated in FIG. 1, depending on the overall length of the pipe sections 21 and 22 and the depth at which the irrigation pipe is buried.

Operation of the present invention may be easily understood with reference to the drawings and above description. The operator 10 is easily and quickly mounted to an irrigation pipe valve 11 through operation of the latching means 31. The embodiment illustrated in FIG. 1 enables the operator to set the lower end of first pipe section 21 over the below ground valve 11 by holding the operator by the levers 40 (which are held in their upward position). He may then rotate the pipe section 21 about its vertical axis to move the latch members 34 into engagement with the dogs 33. The levers 40 are then lowered to slide the bolt members 36 downwardly into their respective sockets 38. This locks the sprinkler and valve operator 10 against axial movement on the valve 12. It also prevents rotation of the first pipe section 21 relative to the irrigation pipe valve 11.

The procedure for mounting the sprinkler and valve operator 10 of the form illustrated in FIG. 5 involves first setting the lower end of first pipe section 21 on the above-ground valve and fastening the collar 32*a* about the lower pipe end and rim 17. With this arrangement, it is ordinarily desirable to make use of the tripod 60. It may be attached to the first pipe section and the legs 61 adjustably extended such that the pads 64 firmly engage the ground surface and brace the pipe sections in a coaxial relationship with the pipe valve 11.

After the valve operator 10 has been securely mounted to the irrigation pipe valve 11, the valve operating mechanism may be turned to open the valve. The operator will first grip the handle 50 via the housing 51 and turn the attached stem members in the direction required to open the valve. If the actuator engaging member has not previously seated against the valve actuator 15, it will slide over the actuator and eventually the concave surface will snap into engagement with the actuator and transmit turning forces thereto.

The handle 50 and housing 51 may be turned along with the second pipe section 22 through provision of the bearing 26. Therefore, the first pipe section will remain stationary while the second pipe section and valve operating mechanism are rotated. Continued rotation of the operating mechanism causes corresponding axial movement of the valve plate to an open condition as shown in FIG. 1. The axial movement is taken up in the valve actuator engaging member 54 through its biased sliding arrangement with the stem members 45 and 46. Similarly, this positive engagement between the actuator engaging member 54 and actuator 15 is assured by the spring 55 as the valve is turned to a closed condition.

With the valve open, water will flow freely along a path coaxial with the irrigation pipe valve 11 and upwardly through the interconnected pipe sections 21 and 22. Therefore, there is little friction loss and none due to sharp bends along the delivery pipe as is present with conventional forms of valve operating mechanisms that lead directly to a single sprinkler head.

The above description was given by way of example to set forth a preferred form of the present invention. This description is not intended to restrict the scope of my invention which is defined only by the claims set out below.

What I claim is:

1. A sprinkler and valve operator mountable directly to an irrigation pipe valve having an exterior valve actuator rotatable about a valve axis to open or close the valve, comprising:

a first pipe section having an upper end and a lower end;

mounting means at the lower end of the first pipe section adapted to releasably secure the first pipe section to the irrigation pipe valve coaxially with the valve axis;

a second pipe section having an upper end and a lower end, said upper end of the second pipe section being adapted to rotatably mount a sprinkler head;

bearing means coaxially joining the upper end of the first pipe section and the lower end of the second pipe section for rotation relative to one another; and valve operating means operably connected to the second pipe section and located within the first and second pipe sections for engaging the exterior valve actuator of an irrigation pipe valve and for opening or closing the irrigation pipe valve in response to manual rotation of the second pipe section relative to the first pipe section and irrigation pipe valve.

2. The sprinkler and valve operator as defined by claim 1, wherein the valve operating means is comprised of:

a first stem member within the pipe sections;

spider bearing means rotatably centering the first stem member within the pipe sections for coaxial rotation therein;

a second stem member operatively mounted to the first stem member for rotation in unison with the first stem member; and a valve actuator engaging member on one of the stem members adapted to engage an exterior valve actuator of an irrigation pipe valve; and means interconnecting the stem members and the second pipe section for turning of the stem members in unison with the second pipe section, whereby the actuator engaging member is enabled to open or close an irrigation pipe valve engaged by it.

3. The sprinkler and valve operator as defined by claim 1 wherein the mounting means includes releasable latch means for fixing the first pipe section to an irrigation pipe valve.

4. The sprinkler and valve operator as defined by claim 1 further comprising:

tripod means removably mountable to the pipe sections for supporting the pipe sections in an upright condition relative to the ground surface.

5. The sprinkler and valve operator as defined by claim 4 wherein the tripod means is comprised of:

a hinged collar removably receivable on the pipe sections;

extensible leg members pivotably mounted to the hinged collar; and ground engaging pads on the leg members.

6. The sprinkler and valve operator as defined by claim 1 wherein the mounting means is comprised of:

a coupler ring adapted to be mounted to an irrigation pipe valve;

a dog protruding from the coupler ring; an L-shaped latch member having an upright leg affixed to the lower end of the first pipe section;

a horizontal leg of the L-shaped latch member having an upper horizontal surface located below the lower end of the first pipe section to receive the dog;

a longitudinally moveable bolt member slidably mounted to the lower end of the first pipe section adjacent the L-shaped latch member; and lever means for moving the bolt member between an inoperative position above and clear of the horizontal leg and an operative position where the bolt member engages the horizontal leg to selectively lock the dog above the horizontal surface and the bolt member and the upright leg of the L-shaped latch member.

7. The sprinkler and valve operator as defined by claim 2 wherein the valve operating means further comprises a spring between the valve actuator engaging member and stem members adapted to yieldably urge the valve actuator engaging member against the exterior valve actuator of the irrigation valve.

8. The sprinkler and valve operator as defined by claim 1 wherein the valve operating means includes a handle member projecting radially from the second pipe section.

9. The sprinkler and valve operator as defined by claim 8, wherein the valve operating means is comprised of:

a first stem member within this pipe sections;

spider and bearings rotatably centering the first stem member within the pipe sections for coaxial rotation therein;

a second stem member operatively mounted to the first stem member for coaxial rotation therewith, and a valve actuator engaging member on one of the stem members adapted to engage and turn an exterior valve actuator of an irrigation pipe valve; and wherein the handle member is releasably mounted to one of the stem members and projects radially therefrom.

10. The sprinkler and valve operator as defined by claim 9 wherein the mounting means is comprised of:

a coupler ring adapted to be mounted to an irrigation pipe valve;

a dog protruding from the coupler ring;

an L-shaped latch member having an upright leg affixed to the lower end of the first pipe section;

a horizontal leg of the L-shaped latch member having an upper horizontal surface located below the lower pipe end of the first pipe section to receive the dog;

a longitudinally moveable bolt member slidably mounted to the lower end of the first pipe section adjacent the L-shaped latch member; and means for moving the bolt member between an inoperative position above and clear of the horizontal leg and an operative position where the bolt member engages the horizontal leg to selectively lock the dog above the horizontal surface and between the bolt member and the upright leg of the L-shaped latch member.

11. The sprinkler and valve operator as defined by claim 6 wherein the lever means is comprised of:

a connector rod having one end mounted to the lever arm and a remaining end attached to the longitudinally moveable bolt members and positioned thereon to move the bolt member between its operative and inoperative positions in response to pivotal movement of the lever arm.

* * * * *